US008662342B1

(12) United States Patent
DeTolla

(10) Patent No.: US 8,662,342 B1
(45) Date of Patent: Mar. 4, 2014

(54) MATERIALS STORAGE METHOD AND DEVICE

(76) Inventor: Andrew John DeTolla, Westford, MA (US)

( * ) Notice: Subject to any disclaimer, the term of this patent is extended or adjusted under 35 U.S.C. 154(b) by 0 days.

(21) Appl. No.: 13/341,867

(22) Filed: Dec. 30, 2011

(51) Int. Cl.
*B65D 81/24* (2006.01)

(52) U.S. Cl.
USPC ..... 220/578; 220/801; 220/803; 215/231

(58) Field of Classification Search
USPC ..... 220/578, 801, 803; 215/231; 222/386; 426/124
See application file for complete search history.

(56) References Cited

U.S. PATENT DOCUMENTS

| | | | | | |
|---|---|---|---|---|---|
| 2,096,358 | A | * | 10/1937 | Gautier | 220/580 |
| 2,677,816 | A | * | 5/1954 | Quist | 73/308 |
| 2,767,890 | A | * | 10/1956 | Carter | 222/386 |
| 2,828,886 | A | * | 4/1958 | Thomas | 220/579 |
| 3,164,289 | A | * | 1/1965 | Cocchiarella | 220/578 |
| 3,781,942 | A | * | 1/1974 | Coleman | 220/578 |
| 3,784,051 | A | * | 1/1974 | Shaw et al. | 220/580 |
| 3,804,635 | A | * | 4/1974 | Weber | 99/283 |
| 3,924,774 | A | * | 12/1975 | Donnelly | 220/580 |
| 3,987,941 | A | * | 10/1976 | Blessing | 222/386 |
| 4,209,105 | A | * | 6/1980 | Dominique | 220/578 |
| 4,471,892 | A | * | 9/1984 | Coleman | 222/386.5 |
| 4,552,090 | A | * | 11/1985 | Coleman | 220/578 |
| 4,723,674 | A | * | 2/1988 | Nunes | 215/231 |
| 4,874,108 | A | * | 10/1989 | Valasek | 220/578 |
| 5,037,009 | A | * | 8/1991 | Shea | 222/386 |
| 5,117,998 | A | * | 6/1992 | Handzel | 220/578 |
| 5,305,909 | A | * | 4/1994 | Merritt | 220/579 |
| 5,361,933 | A | * | 11/1994 | Oster | 220/578 |
| 5,402,908 | A | * | 4/1995 | Warden et al. | 220/554 |
| 5,626,266 | A | * | 5/1997 | Michelson | 222/386 |
| 5,957,338 | A | * | 9/1999 | Lehmann | 222/184 |
| 5,988,423 | A | * | 11/1999 | Auzureau | 220/233 |
| 5,993,096 | A | * | 11/1999 | Martelli | 401/126 |
| 6,290,105 | B1 | * | 9/2001 | Cosentino | 222/387 |
| 6,675,991 | B2 | * | 1/2004 | Johnson et al. | 222/387 |
| 7,182,538 | B2 | | 2/2007 | Grosso et al. | |
| 7,494,025 | B2 | * | 2/2009 | Porter | 220/580 |
| 2004/0238544 | A1 | * | 12/2004 | Miller | 220/578 |
| 2009/0095776 | A1 | * | 4/2009 | Turner et al. | 222/386.5 |
| 2011/0114592 | A1 | * | 5/2011 | Garrison | 215/231 |

* cited by examiner

*Primary Examiner* — Mickey Yu
*Assistant Examiner* — Brijesh V. Patel

(57) ABSTRACT

A method and device for releasably sealing a material into a container is disclosed. The device has a plug handle and a flexible plug body with an exterior edge that conforms to the contours of the interior wall of the container. The plug body is inserted into the container and is positioned to the surface of the material within the chamber using the plug handle. The plug body exerts resistance pressure against the interior wall of the container. The resistance pressure releasably seals the material in the chamber. In certain embodiments, while the plug body is inserted into the container, the resistance pressure squeezes the material from at least a portion of the interior wall of the container down to a pool of the material in the chamber of the container.

22 Claims, 13 Drawing Sheets

MATERIALS STORAGE METHOD AND DEVICE

CROSS-REFERENCE TO RELATED APPLICATION none

FIELD

The present invention relates to the field of materials storage and particularly to sealing paint and other surface coatings for later use.

BACKGROUND

This invention relates to methods and devices which facilitate short to long term storage, using the original container or another container, of a material, such as a liquid or, more particularly, any type of interior or exterior latex or oil based paint, stain or other interior or exterior surface coatings. Note: "paint" is a general term used in this document to refer to all of the types of surface coatings referenced above.

The price of premium paint cost in excess of $50 per gallon. Having a convenient and cost effective way to preserve paint freshness for short or long periods of time protects this investment. Storing partially filled containers of paint for medium to long periods of time causes evaporation, and as a result, a paint skin forms on the surface. The evaporation problem is greatly accelerated in warm outdoor conditions, where paint is often stored in a secondary container for short periods of time on a project basis. Evaporation results in paint becoming thick and chemically compromised. The paint may be too thick to reconstitute and must be discarded, resulting in a waste of money and further stress on landfills or other methods of waste disposal. For oil based coverings, the air in the container may cause the paint to become oxidized, resulting in a thick skin of the coating to form on the surface. This may also result in the paint becoming chemically compromised and thickened. In addition, the skin that forms on the surface of the paint and on the interior wall of the paint can may fragment and contaminate the remaining paint, forcing the remaining paint to be discarded.

Various devices have been proposed in the art such as transferring unused paint to a separate storage container or removing the metal lid and replacing it with a flexible lid with a spout and seal. In addition, other devices have been proposed in which the air has been vacuumed out of a storage container. However, vacuums may accelerate evaporation, and so may not be suitable for use in storing paint, where evaporation may degrade the quality of the remaining paint.

It is assumed that these devices are useful for their intended purpose, however, these devices do not offer a convenient and relatively inexpensive way to preserve paint for short to long periods of time, whether or not they use the original product packaging, and in the case of the flexible or vacuumed lid, does not address the evaporation and oxidation issues from the air volume within the partially empty container.

Therefore, it is desirable to have a simple, easy to use paint plug device, which may be re-used many times and for many different types of paint or other coating materials, which does not require the expense and inconvenience of purchasing redundant and potentially expensive storage kits or containers, transferring the materials, or cleaning these containers before re-use.

SUMMARY

A materials storage device comprises a plug device, used to preserve materials for future use. The plug device may be used to store the material in its original container packaging for short or long term use, or may be used to preserve materials in an external container for short term projects. The plug device may be used to seal a material into a container having an interior bottom and an interior wall defining a chamber for holding the material. The plug device has a flexible plug body that is sized to be positioned within the container, and the plug body has an exterior edge that conforms to the contours of the interior wall of the container. The exterior edge is sized to simultaneously fit within the container at a top surface of the material within the chamber and to exert resistance pressure against the interior wall of the container for releasably sealing the material in the chamber. The device also has a plug handle section attached to the plug body and extending from the plug body to a free end. The plug handle section is arranged to facilitate inserting the plug body into the container to the top surface of the material within the chamber.

In certain embodiments, the cross-section of the chamber of the container is round. In others, the chamber of the container has a non circular cross-section, and the plug body is non-circular to accommodate the non-circular cross-section of the container.

In other embodiments, the plug body is sized to squeeze material from at least a portion of the interior wall of the container while the plug body is being inserted into the container, and to push the squeezed material into a pool of the material in the chamber of the container. In other embodiments, the plug body has at least one additional seal to facilitate the sealing of the container. In even further embodiments, the exterior edge of the plug body is sized to be slightly larger in size than the contours of the interior wall of the container.

In certain embodiments, the plug handle system has a strap attached to the plug body, while in others, the plug handle system has an extraction grip attached to the plug body. In other embodiments, the plug handle system has a height reference system for determining a depth of the material in the chamber of the container to facilitate positioning the plug body within the container. The height reference system may have a depth gage slidably disposed on a strap to represent a depth of the material in the chamber of the container, and the height reference system may have depth markings on a strap attached to the plug body to represent an extent to which the material is filling the chamber.

In certain embodiments, the plug body has an inflatable bladder to form the exterior edge of the plug body, a tube seal such as a check valve for receiving air pumped into the tube to inflate the bladder and for releasing air from the bladder to deflate it, and a seal inflation tube that extends between the bladder and the tube seal for transferring the air into and out of the bladder.

In certain embodiments, the plug body comprises a flexible segmented compressible tube; in others, the plug body and plug handle section are formed into a single integrated unit. In further embodiments, the device has a removable plug cover sized to at least partially cover the plug body and to form a barrier between the plug body and the material in the chamber of the container.

A method is also disclosed for releasably sealing a material into a container having an interior bottom and an interior wall defining a chamber for holding a quantity of the material. The method comprises providing a flexible plug body that is sized to be positioned within the container. The plug body has an exterior edge that conforms to the contours of the interior wall of the container and is arranged to exert resistance pressure against the interior wall of the container. The plug body is inserted into the container to a top surface of the material within the chamber; and resistance pressure of the plug body against the interior wall of the container releasably seals the material in the chamber. In certain embodiments, the resistance pressure is used to squeeze the material from at least a portion of the interior wall of the container while the plug body is being inserted into the container, and the squeezed material is pushed into a pool of the material in the chamber of the container.

In certain other embodiments, a height reference system is used to determine a depth of the material in the chamber of the container; the plug body is positioned within the container with reference to the determined depth. In further embodiments, at least a portion of the plug body may be releasably covered with a removable thin film to form a barrier between the plug body and the material in the chamber of the container.

This plug device and method of material storage is very adaptable and may be used to extend the shelf life of materials such as paint in their original containers or preserve the material for short periods of time by using the plug device in conjunction with a separate container.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate one (several) embodiment(s) of the invention and together with the description, serve to explain the principles of the invention.

DETAILED DESCRIPTION

Figure 1A:
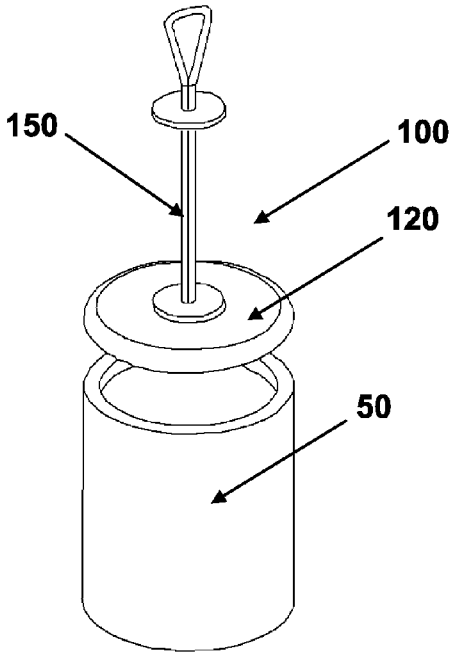
FIG. 1*a* is a perspective view of an exemplary material storage device 100, also known as a plug device 100, as removed from a material container such as a paint can 50.
Figure 1B:
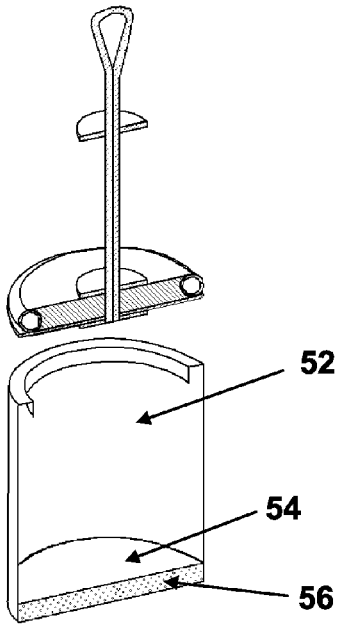
FIG. 1*b* is a perspective sectional view of the plug device 100 and can 50 as shown in FIG. 1*a;*
Figure 1C:
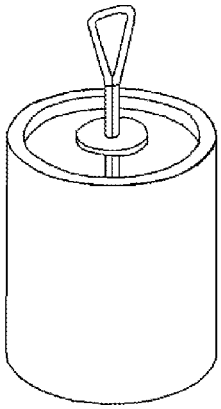
FIG. 1*c* is a perspective view of the plug device 100 of FIG. 1*a* as installed in the can 50.
Figure 1D:
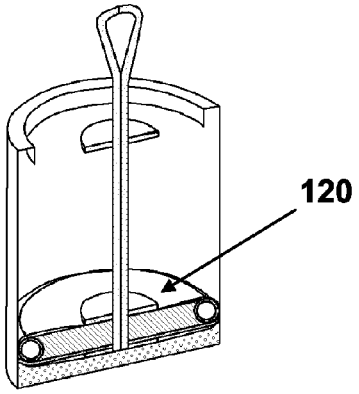
FIG. 1*d* is a perspective sectional view of the plug device 100 and can 50 of FIG. 1*c;*

Reference will now be made in detail to the present exemplary embodiments, examples of which are illustrated in the accompanying drawings. Wherever possible, the same reference numbers will be used throughout the drawings to refer to the same or like parts.

A material storage device 100 according to the present invention will now be described in detail with reference to FIGS. 1*a* to 1*d* and 2*a* to 2*e* of the accompanying drawings. The material storage device 100, also known as a plug device 100, may be used to plug a container of a material such as but not limited to paint. The plug device 100 may include a flexible plug body 120 and a plug handle section 150. The plug device 100 may be positioned within a materials container such as a paint can 50 slightly above or touching the surface 54 of the paint 56 to seal the can after it has been opened and to prevent the paint surface 54 from forming a skin which could contaminate the remaining stored paint. The plug body 120 may be formed of a flexible material and may have a diameter that is the same as or slightly larger than the diameter of the interior wall 52 of the can 50.

In operation, the plug body 120 is positioned at the top of the can 50 and pushed down along the interior wall 52 of the can 50 to the surface 54 of the paint 56. The plug body 120 exerts resistance pressure against the interior wall 52 of the can 50. As the plug body 120 is pushed down into the can 50 to the surface 54 of the paint, the resistance pressure causes the plug body 120 to scrape the paint on the interior surface 52 of the can down into the body of the paint 56 in the can, thus conserving paint and preventing any excess paint from forming a skin on the sides of the can which could contaminate the remaining stored paint. When the plug body 120 is positioned within the can 50 slightly above or touching the surface 54 of the paint 56, it seals the can and removes the air between the paint surface and the bottom of the paint plug device surface, thus preventing the paint surface 54 from forming a skin which may contaminate the remaining stored paint and preventing evaporation which may cause the paint to become thick and unusable.

Figure 2A:
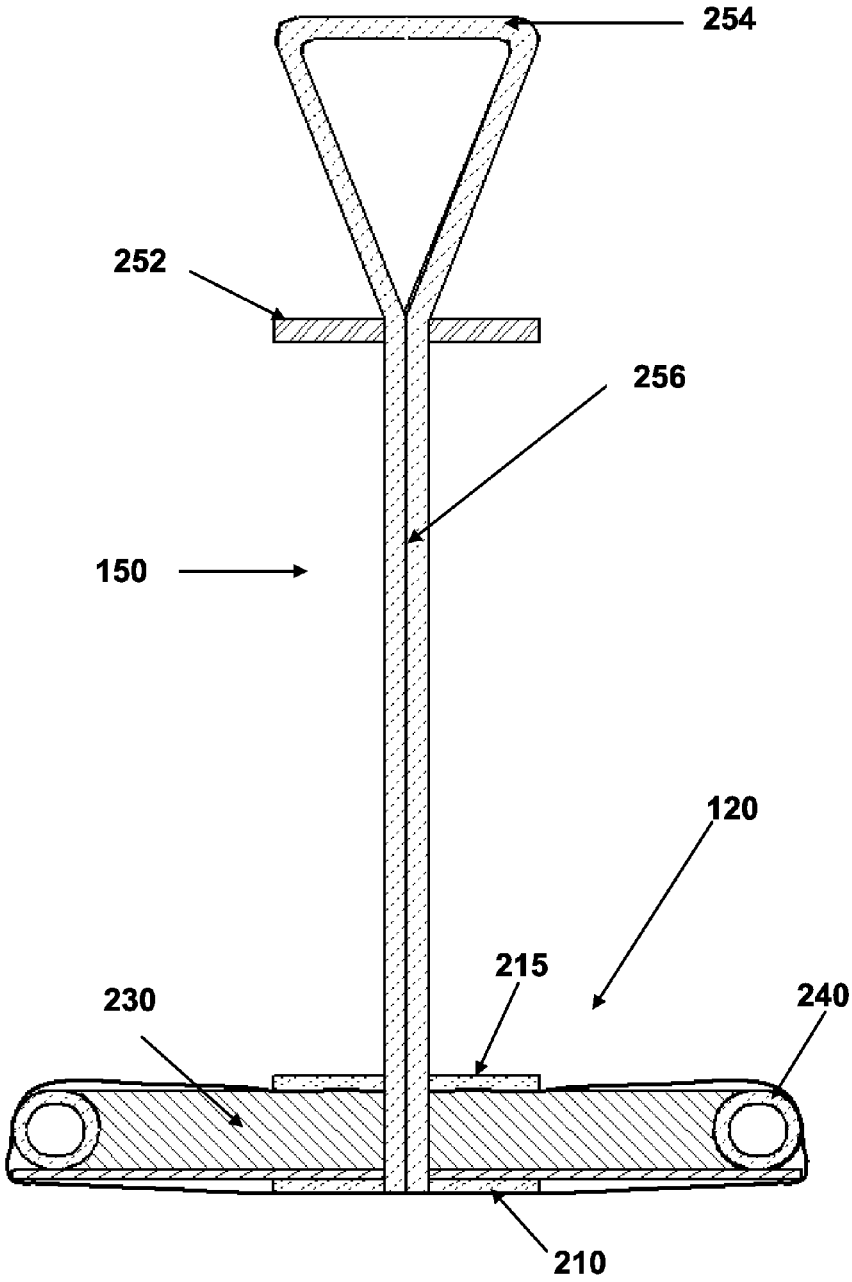
FIG. 2*a* is a sectional view of the plug body 120.
Figure 2B:
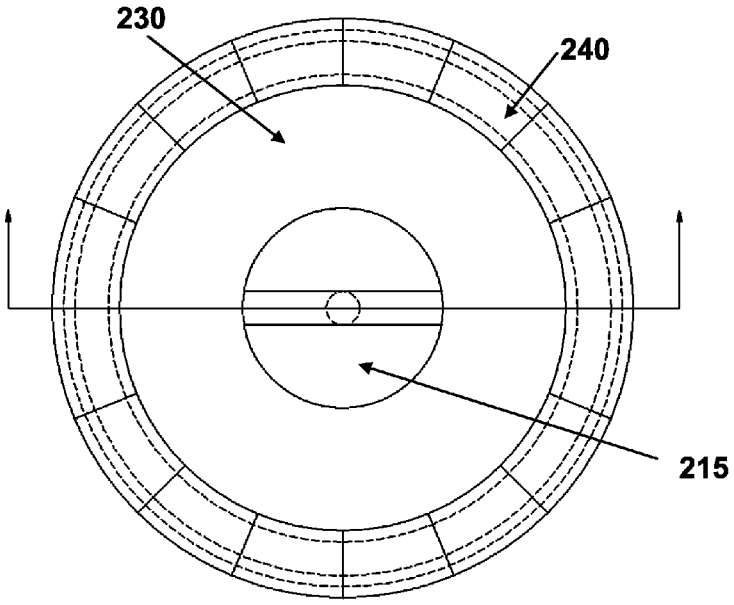
FIG. 2*b* is a top view of the plug body 120.

As shown in FIG. 2*a*, the plug body 120 has a body interior 230, a primary seal 240, a bottom reinforcement disc 210, and a top reinforcement disc 215. The primary seal 240 may be a circular flexible tube (a torus) with an outwardly facing curved surface and arranged to provide resistance pressure against the interior surface 52 of the can. In the embodiment shown in FIG. 2*a*, the primary seal 240 is a hollow torus, but it may be also formed of a compressible material that, when the seal is inserted into the can, will form the desired resistance pressure on the interior surface 52 of the can 50. As shown in FIG. 2*b*, the tube may be segmented along a radial pattern to provide the plug body with flexibility to facilitate inserting the plug device 100 into the can. In further embodiments, the primary seal 240 may have an oblong cross section, not shown, to improve the desired resistance pressure when the plug body 120 is compressed within and fitted against the interior wall of the paint can 50.

Figure 2C:
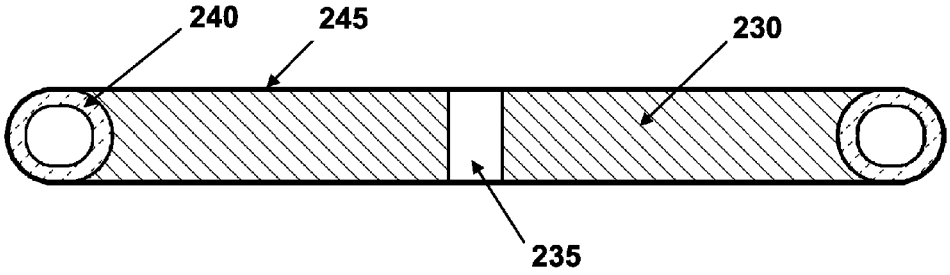
FIG. 2*c* is a sectional view of the primary seal 240 of the plug body 120.

The body interior 230 may be a circular disc, formed of a medium to high density sponge material, with an outer edge onto which the primary seal 240 fits to form a larger disc having a diameter approximately the diameter of the interior wall 52 of the paint can 50. In certain embodiments, the diameter of the plug body is slightly larger than the diameter of the interior wall of the can, in order to facilitate the seal. As shown in FIG. 2*c*, the body interior 230 may have an aperture 235 into which the extraction strap 256 may fit.

The plug body may also have a membrane 245 that encloses and attaches the body interior 230 and the primary seal 240. The membrane material may be made of any suitable plastic or fabric material. The bottom reinforcement disc 210, positioned below the body interior 230, and the top reinforcement disc 215, positioned above the body interior 230, provide stability to the plug body 120. The top reinforcement disc 215 may be formed of plastic or any suitable material, and may have an aperture sized to frictionally receive the extraction strap 256. The bottom reinforcement disc 210 may be formed of plastic or any suitable material, and may be used to reinforce the plug body and constrain the end of the extraction strap 256.

In addition, the plug body 120 may have a plug cover 290 that entirely covers the plug body to form a protective barrier between the paint, paint can sidewalls, and the paint plug external surfaces. The protective film may keep the paint material off of the paint plug device and prevent potential chemical reaction. The plug cover 290 may be held in place against the membrane 245 by placing its edges between the top reinforcement disc 215 and the membrane 245 and pressing the disc 215 against the membrane 245, with friction operating against the extraction strap 256 to hold the reinforcement disc 215 in place against the membrane 245. The plug cover 290 may also have an elasticized edge that fits over the plug body 120 to facilitate holding the cover in place. The plug cover 290 may be made from thin plastic film, such as those used in food storage bags, so that it is disposable after each use. The plug cover 290 may have suitable coatings applied, such as Teflon™ non-stick coating available from DuPont Co. of Wilmington, Del. to reduce paint adhesion to the paint plug and potential chemical reaction with the paint material. The choice of coatings may depend on the composition of the paint, for example, whether the paint is oil- or water-based.

Figure 2D:
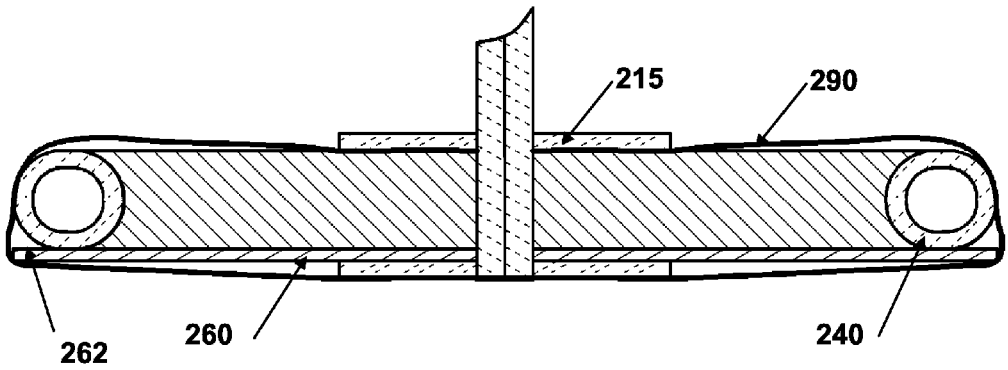
FIG. 2*d* is a sectional view of the uninstalled plug body 120.
Figure 2E:
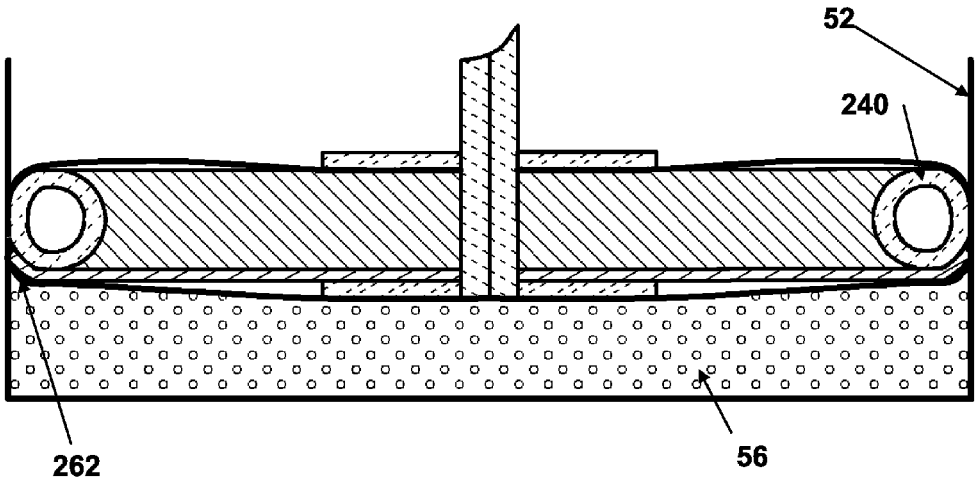
FIG. 2*e* is a sectional view of the plug body 120, as installed in the can 50.

The plug body 120 may optionally also have a lower seal 260 that is located below the primary seal 240 along the radial axis of the flexible plug body to cover the lower surface of the primary seal 240. The lower seal 260, as shown in FIG. 2*d*, may be disc shaped and formed from a flexible material such as rubber or vinyl, and may have the same shape as the primary seal 240, such as round or oval. Additionally the lower seal 260 may have a slightly larger diameter than the primary seal 240. The lower seal 260 may be used in conjunction with the primary seal 240 to improve the air seal. In addition, the lower seal 260 may cover the entire lower surface of the plug body and be used to help the plug body retain its shape over many uses and over a long period of time. FIG. 2*d* shows the lower seal 260 before use. FIG. 2*e* shows the plug body 120 in operation inside a can 50, with the plug body 120 resting on the surface 54 of the paint 56, the primary seal 240 compressed against the interior wall 52 of the can, the lower seal covering the surface 54 of the paint 56, and the outer edge 262 of the lower seal 260 against the interior wall 52 and curled upward toward the primary seal 240, thus sealing the paint 56 in the can 50. As shown in FIG. 2*e*, the primary seal and the lower seal are configured to interact and to act independently to exert the resistance pressure against the interior wall of the container and to scrape the material from the interior wall of the container as the flexible plug body is being pushed down into the container.

An embodiment useful in positioning the plug within the can 50 is shown in FIGS. 2*a* and 9*a*-9*e*. As shown in FIG. 2*a*, the plug handle section 150 has a height reference disc 252 (also known as a depth gage disc), a strap handle 254, and an extraction strap 256. The depth gage disc 252, which is shown as round, but may be any convenient shape, may be made of plastic or any suitable material, and may be used in conjunction with the extraction strap 256 as a reference to determine the depth to position the paint plug within the can 50. The extraction strap 256 may be made of nylon or other rope type of material and may be used to extract the paint plug from the paint can 50. It may also be used to stabilize the paint plug when inserting it into the paint can 50 and to provide frictional pressure against the top reinforcement disc 215 to hold it in place against the membrane 245.

Figure 9A:
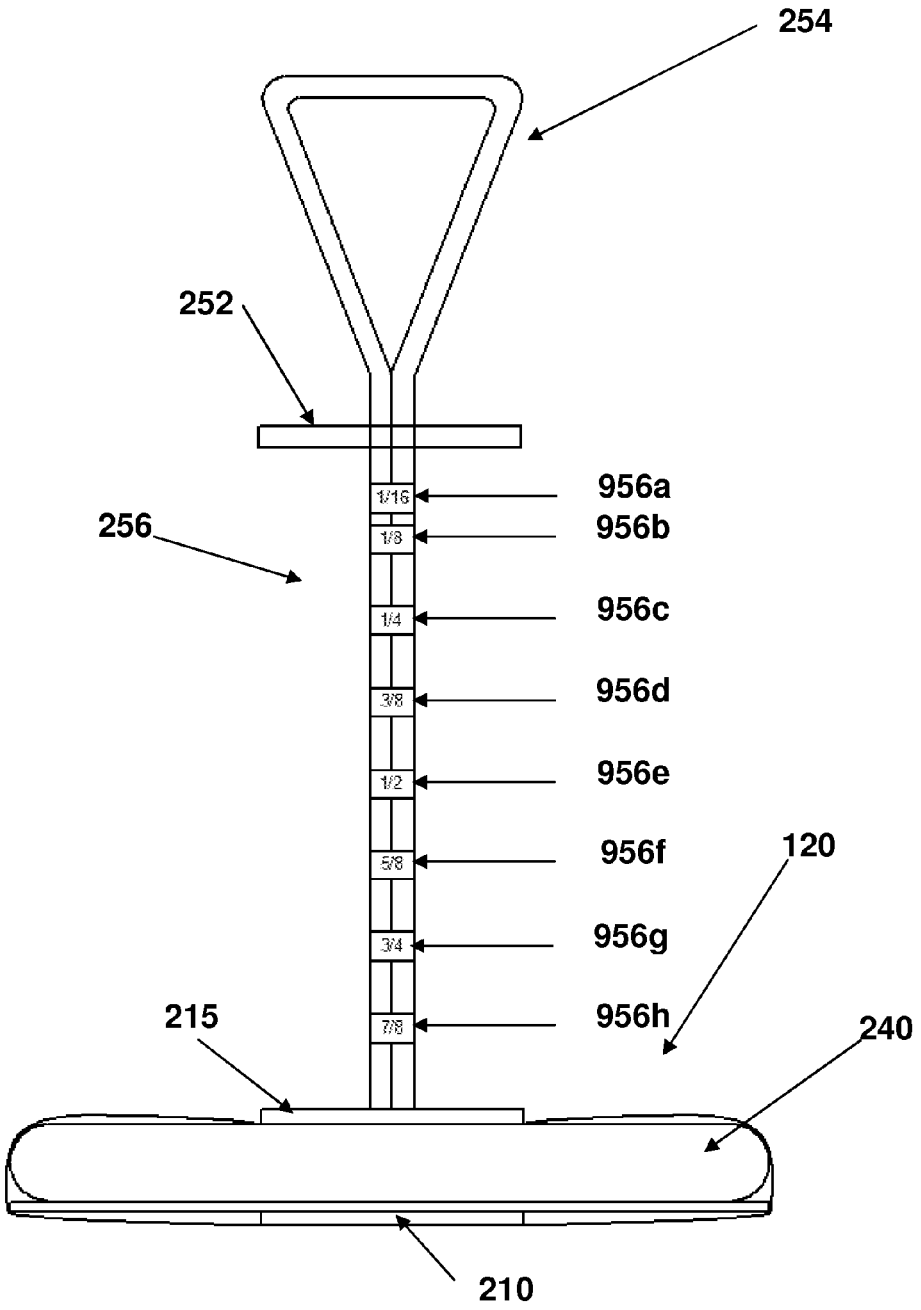
FIG. 9*a* is a front view of plug device 100, showing the height reference disc 252; and detailed height markings on extraction strap 256.

The extraction strap 256 may have also have depth markings 956*a*-956*h*, shown in FIG. 9*a*, to identify how much paint is left in the can 50. FIG. 9*a* shows the plug device 100 in a de-compressed state, with depth markings 956*a*-956*h* on extraction strap 256 that may be coded with a fractional scale such as, respectively, 1/16, 1/8, 1/4, 3/8, 1/2, 5/8, 3/4, 7/8, to indicate approximately how much paint is remaining in the can. When the depth gage is set, the markers show approximately how much paint is remaining in the can.

Figure 9B:
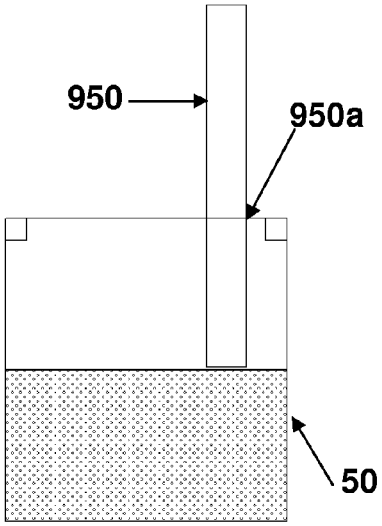
FIGS. 9*b*, 9*d*, and 9*e* are front sectional views
Figure 9C:
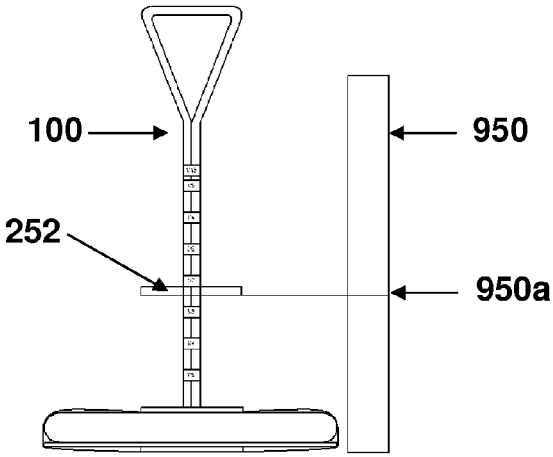
FIG. 9*c* is a front view showing an exemplary process for positioning the plug in the can 50.
Figure 9D:
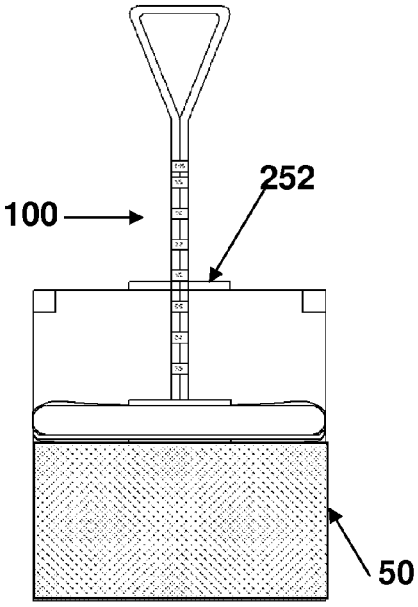
Figure 9E:
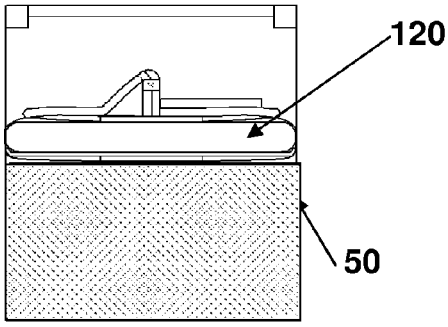

In order to set the height of the depth gage disc 252, as shown in FIG. 9*b*, a user of the paint plug device may insert a paint stirrer 950 or similar item into the paint can 50 until it touches the surface of the paint, then grip the top of the paint stirrer at the top of the paint can at position 950*a*, thus establishing the depth to set the paint plug. The user may move the stirrer 950 to the plug device 100 and, as shown in FIG. 9*c*, reference this measurement by moving the depth gage disc 252 along the extraction strap 256 until the height from the bottom of the paint plug to the bottom of the depth gage disc 252 is the same as the measured depth 950*a*. Once the depth gage disc 252 height is set, as shown in FIG. 9*d*, the user may reference the closest depth markings, shown in FIG. 9*a*, on extraction strap 256 to the depth gage disc 252 height.

When the paint plug device is inserted into the paint can, the user may put some tension on extraction strap 256 by holding strap handle 254 above the paint can 50 while lowering the paint plug into the can 50 with the other hand. The user may stop lowering the paint plug when the depth gage disc 252 is visually aligned to the top of the paint can 50. The user may then drop the extraction strap 256 into the can 50. For maximal sealing or medium to long term storage, the user may also replace the paint lid. The depth gage disc 252 is a convenience feature. A frequent user of the paint plug device may be able to judge the depth of the plug based on the change in resistance when pressing the plug against the paint surface and may not require the use of the depth gage disc 252 on a regular basis.

Figure 3A:
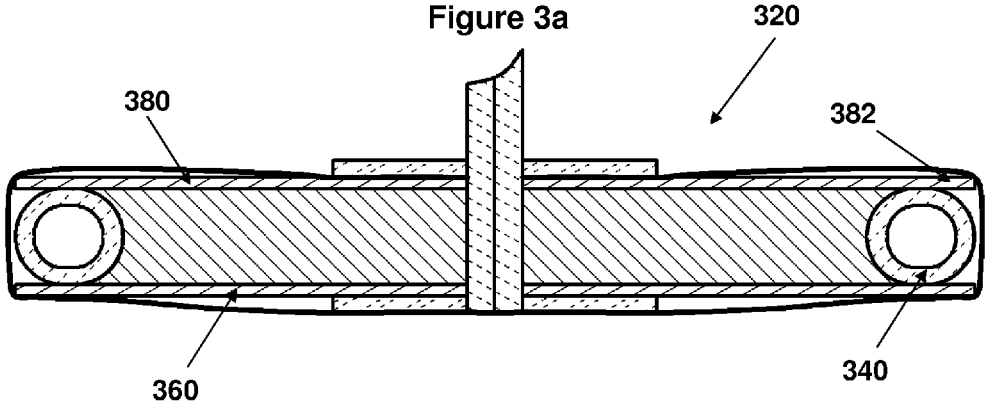
FIG. 3*a* is a sectional view of an exemplary plug body 320.
Figure 3B:
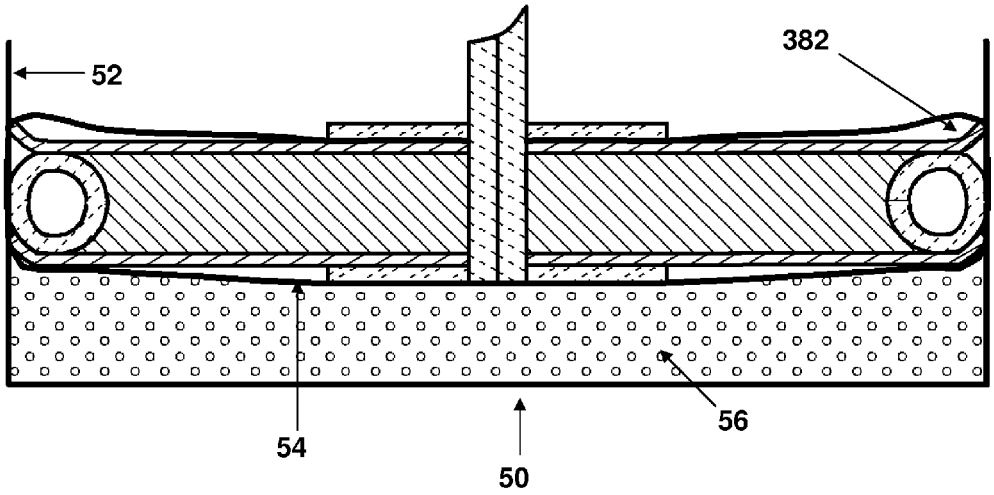
FIG. 3*b* is a sectional view of the plug body 320, as installed in the can 50.

In other embodiments, a plug body 320 may have an upper seal to form additional sealing for improved air tight long term storage. FIGS. 3*a* and 3*b* show an embodiment in which an upper seal 380 is positioned above the primary seal 340. The upper seal 380 may be disc shaped and formed from a flexible material such as rubber or vinyl, and may have the same shape as the primary seal 340, such as round or oval. Further, the upper seal 380 may cover the entire upper surface of the plug body and be used to help the plug body retain its shape over many uses and over a long period of time. Although it is shown in FIG. 3*a* in a plug body that has a lower seal 360, the upper seal 380 may be included on a plug body without a lower seal. In embodiments where it is included with the lower seal, the upper seal may be identical in shape and material to the lower seal.

FIG. 3*a* shows the upper seal 380 before use. FIG. 3*b* shows the plug body 320 in operation inside a can 50, with the plug body 320 resting on the surface 54 of the paint 56, the primary seal 340 compressed against the interior wall 52 of the can, and the outer edge 382 of the upper seal 380 against the interior wall 52 and curled upward away from the primary seal 340, thus providing additional sealing of the paint 56 in the can 50.

Figure 4:
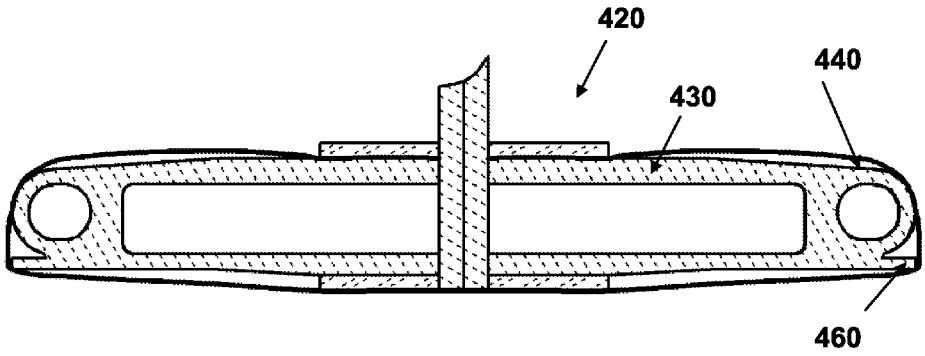
FIG. 4 is a sectional view of an exemplary integrated plug body 420.

In other embodiments, as shown in FIG. 4, an integrated plug body 420 may have a plug interior 430, primary seal 440, and lower seal 460 formed into a single molded component. This single molded piece may be made of rubber or any suitable material that will allow the plug to exert the desired resistance pressure against the interior walls of a paint can.

Figure 5:
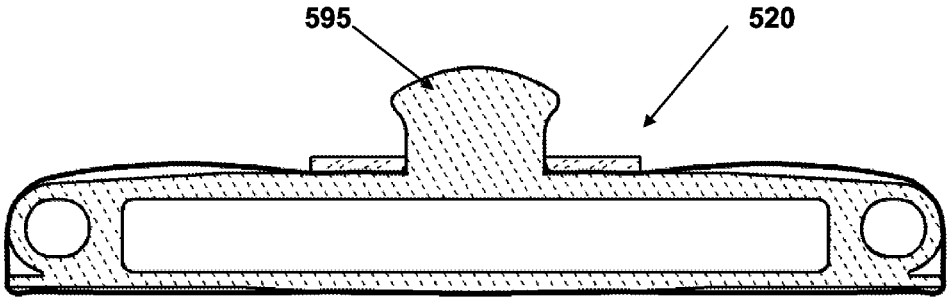
FIG. 5 is a sectional view of an exemplary integrated plug body 520 with an integrated extraction grip 595.

In further embodiments, as shown in FIG. 5, the plug body 520 may also have an integrated extraction grip 595 that may be used instead of the extraction strap to extract the paint plug from shallow, smaller cans. For example, a typical 8 ounce paint can has an approximate 2 inch diameter can opening and a 2½ inch can depth. The integrated extraction grip 595 may be gripped between the thumb and index finger to insert and extract the paint plug device scaled down for this type of application.

Figure 6A:
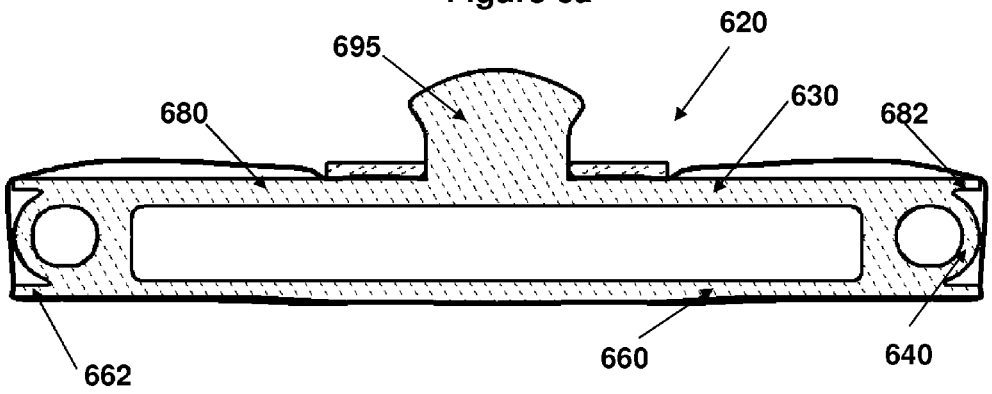
FIG. 6*a* is a sectional view of another exemplary plug body 620.
Figure 6B:
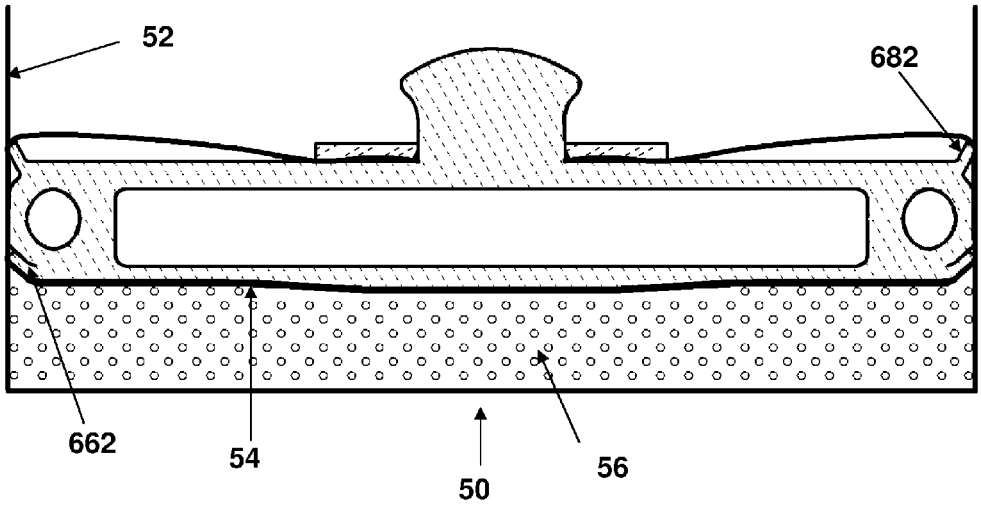
FIG. 6*b* is a sectional view of the plug body 620, as installed in the can 50.

FIG. 6*a* shows an exemplary integrated plug body 620 that has a plug interior 630, primary seal 640, lower seal 660, upper seal 680, and extraction grip 695 formed into a single molded component. FIG. 6*b* shows the plug body 620 in operation, with the plug body 620 resting on the surface 54 of the paint 56, the primary seal 640 pressed against the interior wall 52 of the can. The outer edge 662 of the lower seal 660 is pressed against the interior wall 52 and curled upward away toward the primary seal 640, and the outer edge 682 of the upper seal 680 is pressed against the interior wall 52 and curled upward away from the primary seal 640, thus providing additional sealing of the paint 56 in the can 50.

Figure 7A:
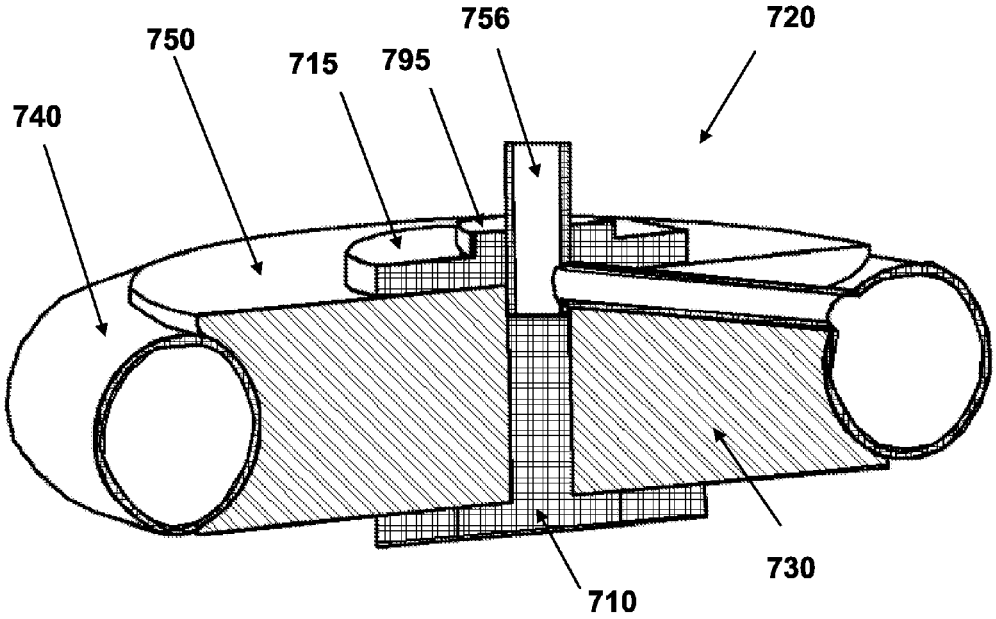
FIG. 7*a* is a perspective sectional view of an exemplary plug body 720 that features an inflated primary seal bladder 740.
Figure 7B:
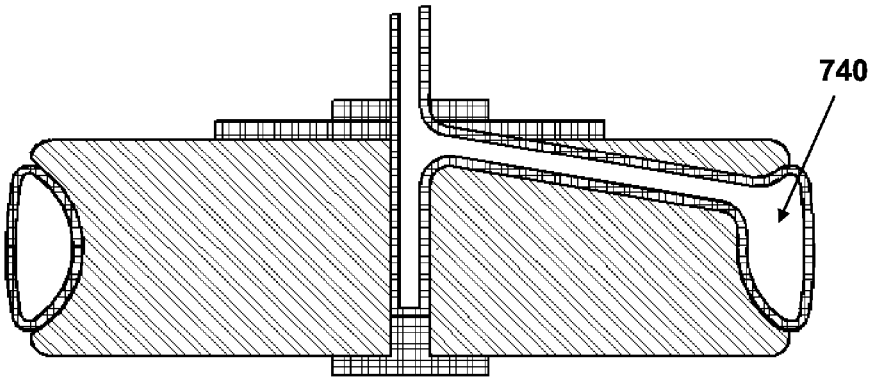
FIG. 7*b* is a sectional view of the plug body 720 showing the primary seal bladder 740 in a deflated position.
Figure 7C:
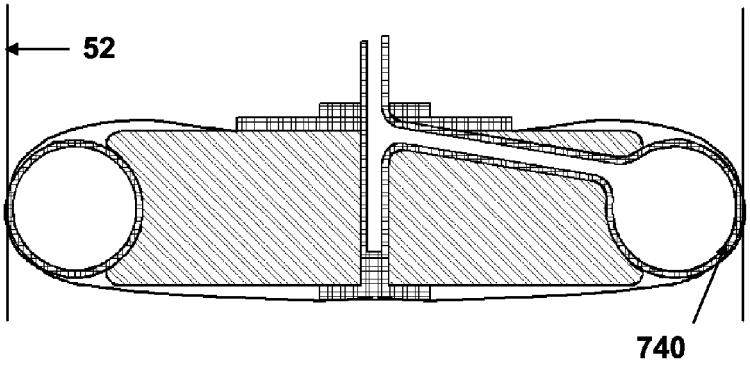
FIG. 7*c* is a sectional view of the plug body 720 showing the primary seal bladder 740 in an inflated position as installed in the can 50.

In another embodiment, as shown in FIGS. 7*a*-7*c*, a plug body 720 may be inflated to expand and compress against the interior wall 52 of the paint can. The plug body 720 may have a body interior 730 which may be made of a solid material such as recycled plastic and may have a concave surface on its outer diameter to keep the primary seal bladder 740 from slipping off the body when deflated and to provide stability to the primary seal bladder 740 when it is inflated. A seal inflation tube 756 may be attached to one end of the primary seal bladder 740 and at the other end to a tube seal, for example a conventional air valve (not shown) such as those used in a sport ball. The attachments may be outside of the body or inside, and the body may have a channel for the parts. A top reinforcement disc 715 and tube reinforcement disc 795 may be molded with the seal inflation tube 756 into a single unit. A bottom reinforcement disc 710 serves as a inflation tube plug and snaps into the bottom of the inflation tube 756 to hold it in place when placing and extracting the paint plug device.

In operation, the user may lower the plug with the deflated primary seal bladder using the seal inflation tube 756 until the plug is below the level of the top of the can. Air pumped through the air valve and tube 756 may partially inflate the primary seal bladder 740. As the seal is being pushed down to the surface of the paint, the partially inflated primary seal bladder 740 pushes against the interior wall 52 of the paint in order to scrape the interior walls of the can. Once the plug body 720 is in place, air is pumped through the tube 756 to finish inflating the primary seal bladder 740, thus completing a seal. Alternatively, in embodiments when scraping the interior walls of the container is not desired, the plug body 720 may be dropped to the surface of the paint. When the plug body is in place, the air is pumped through the tube 756 to inflate the primary seal bladder 740, thus creating the seal. When the user wants to unseal the paint can, he releases the air valve, causing the air to exit the tube 756 and deflate the primary seal bladder 740. The plug may then be extracted from the paint can by pulling the paint plug body 720 out of the can, for example by the tube 756.

Figure 8A:
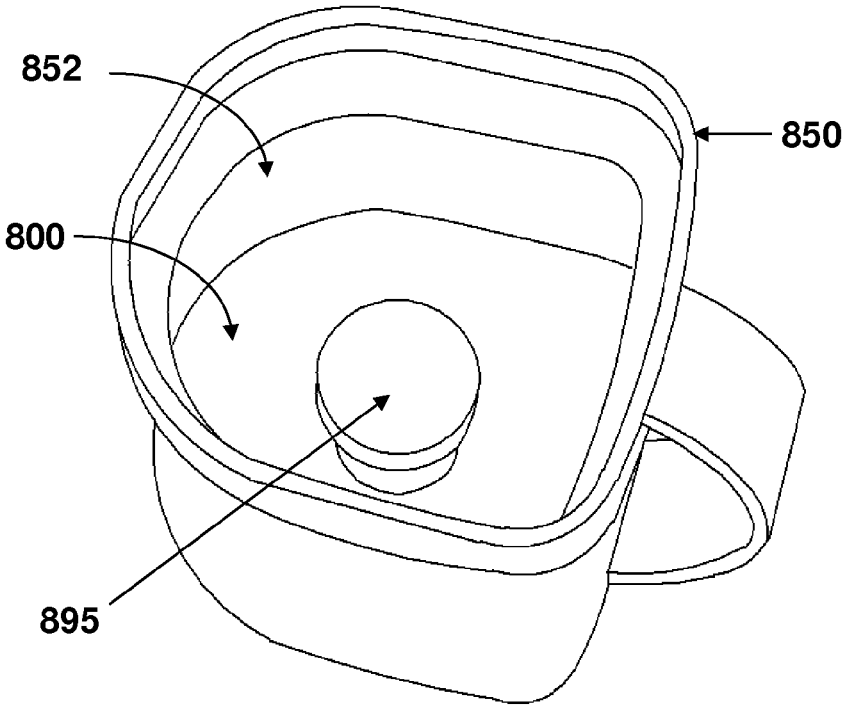
FIG. 8*a* is a perspective view of an exemplary molded paint plug 800 that may be used with an alternatively shaped paint container 850, also known as a bucket 850.
Figure 8B:
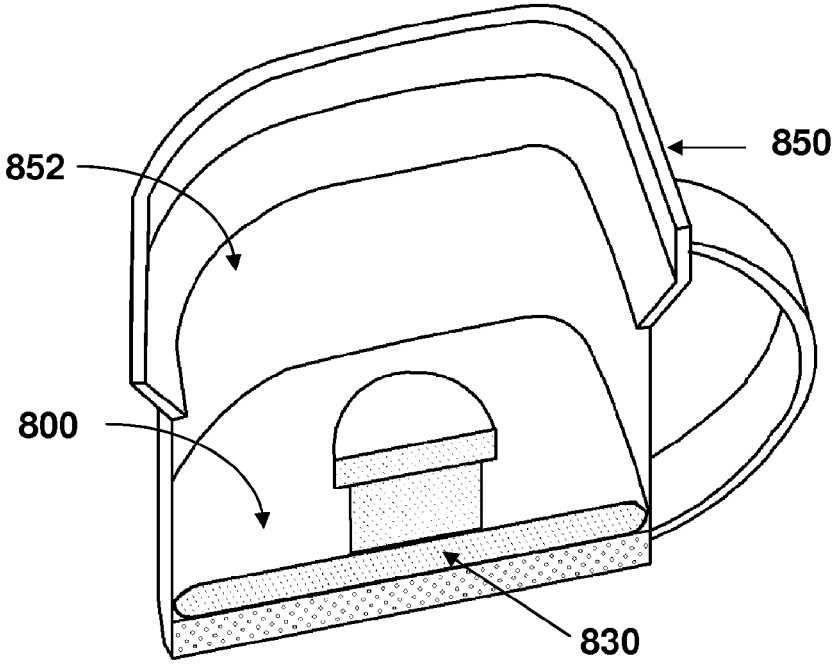
FIG. 8*b* is a perspective sectional view of an exemplary molded paint plug 800 that may be used with an alternatively shaped paint container 850 of FIG. 8*a;*

The paint plugs may be manufactured in a family of plug sizes to accommodate standard size paint containers, including, but not limited to 1 gallon, 1 quart and ½ pint sizes. In addition, the paint plugs may be manufactured in different shapes to accommodate the shape of the paint can or other material container. For example, FIGS. 8*a* and 8*b* show a bucket 850 commonly used to hold paint during a painting job, with molded paint plug 800 installed as a seal. The bucket 850 has a non-circular interior wall 852.

Figure 8C:
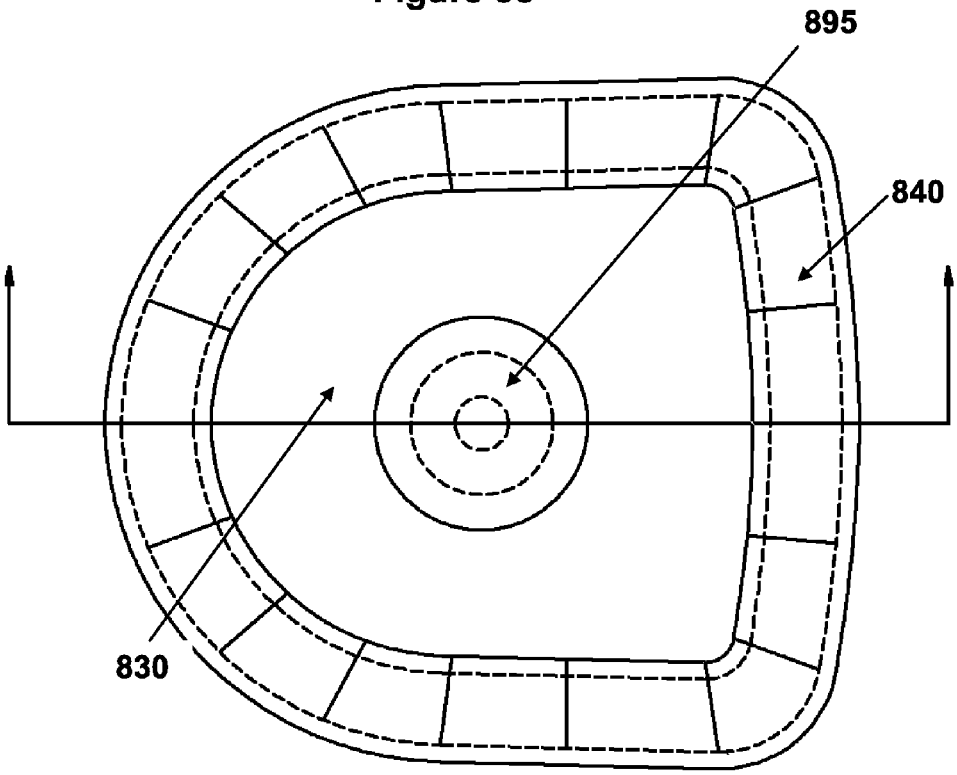
FIGS. 8*c* and 8*d* are, respectively, a top plan view and a sectional view of molded paint plug 800.
Figure 8D:
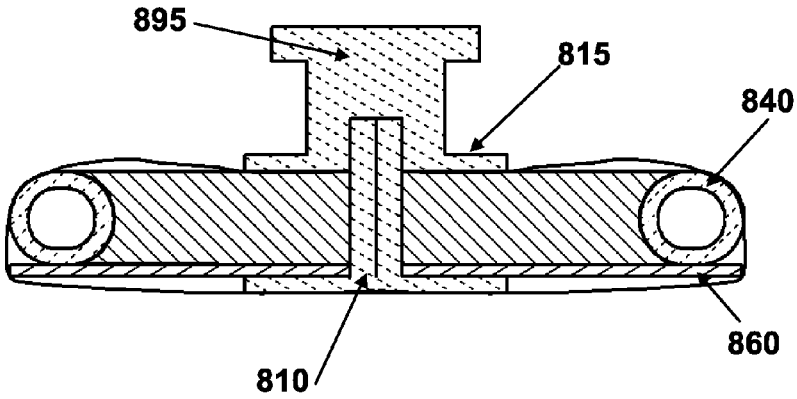

FIGS. 8*c* and 8*d* show more detail of the molded paint plug 800 that may be used to seal the bucket 850. The molded paint plug 800 has a non-circular shape that conforms to the shape of the interior walls 852 of the bucket 850. The molded paint plug 800 may be formed of a compressible material that, when the seal is inserted into the bucket 850, forms the desired resistance pressure on the interior surface 852 of the bucket 850. The molded paint plug 800 may have a grip 895, a body interior 830, a primary seal 840, a bottom reinforcement disc 810, and a top reinforcement disc 815.

As with the embodiment shown in FIGS. 2*a*-2*e*, the primary seal 840 may be a flexible tube that is segmented, for example, along a radial pattern to provide plug body with flexibility to facilitate inserting the molded paint plug device 800 into the bucket 850. The molded paint plug 800 may also have a lower seal 860 to improve the seal.

It may be seen that the embodiments of the devices and methods for sealing paint cans disclosed here may be used to greatly extend the shelf life of partially used paint within the original packaging. Many features are described that may be included in storage plug devices to accommodate the best price performance based on the type of paint being stored and how long it is intended to be stored. For example, if a paint is more expensive or if it is intended that the paint be stored for longer periods of time, the user may select an embodiment of the device that has additional upper and lower seals, to ensure increased sealing performance. The unique paint container wall scraping feature may be incorporated into a device to avoid paint contamination and maximize the amount of paint preserved for future use. In addition, the disclosed devices and methods reduce environmental stress on landfills because paint will last much longer and may be available for use for a longer period of time. The disclosed features reduce the cost associated with safe disposal of paint material, because less paint is wasted.

One of skill in the art will appreciate that the above-described stages may be embodied in several ways. Although the disclosed components have been described above as being separate units, one of ordinary skill in the art will recognize that functionalities provided by one or more units may be combined. As one of ordinary skill in the art will appreciate, one or more of units may be optional and may be omitted from implementations in certain embodiments. In addition, while the embodiments above have been described with reference to storing paint for reuse, it is to be understood that the devices and methods described herein are not limited to storing paints. Instead, the embodiments described herein may be used to store any materials, such as any liquids or solids, where there is a need to provide secure sealing for short or longer periods.

The foregoing descriptions have been presented for purposes of illustration. It is not exhaustive and does not limit the invention to the precise forms or embodiments disclosed. Modifications and adaptations of the invention will be apparent to those skilled in the art from consideration of the specification and practice of the disclosed embodiments. For example, the described implementations may be implemented in a variety of materials, sizes and shapes, and be arranged differently than the figures illustrate. It is intended that the specification and examples be considered as exemplary only, with a true scope and spirit of the invention being indicated by the following claims.

The invention claimed is:

1. A plug device for a container, the plug device comprising:

a flexible plug body that is sized to be positioned within the container for releasably sealing material into the container, wherein the flexible plug body has a plurality of seals that conform to contours of an interior wall of the container and that simultaneously fit within the container and exert resistance pressure against the interior wall of the container when the plug device is inserted into the container, and wherein the plurality of seals comprises a primary seal and a lower seal that is located below the primary seal along the radial axis of the flexible plug body, wherein the primary seal has a flexible tubular structure with an outwardly facing curved surface, wherein the lower seal covers a top surface of the material within the container when the plug device is inserted into the container, and wherein the lower seal has a flexible outer edge for operating in conjunction with the primary seal to improve the releasable sealing by extending outwardly from a center portion of the flexible plug body further than the primary seal when the plug device is not inserted into the container, and curling upwardly toward the primary seal to compress one side of the lower seal into the outwardly facing curved surface of the primary seal and to compress the other side of the lower seal into the interior wall of the container when the plug device is inserted into the container;

a plug handle section attached to the flexible plug body and extending from the flexible plug body to a free end, wherein the plug handle section is arranged to facilitate inserting the flexible plug body into the container to the top surface of the material within the container.

2. The plug device of claim 1, wherein the flexible plug body is sized to squeeze a portion of the material from at least a portion of the interior wall of the container while the flexible plug body is being inserted into the container, and to push the squeezed portion of the material into a pool of the material in the container.

3. The plug device of claim 1, wherein the plug handle section comprises a strap attached to the flexible plug body.

4. The plug device of claim 1, wherein the plug handle section comprises an extraction grip attached to the flexible plug body.

5. The plug device of claim 1, wherein the plurality of seals are sized to be slightly larger in size than the interior wall of the container.

6. The plug device of claim 1, wherein the cross-section of the plurality of seals is round.

7. The plug device of claim 1, wherein the flexible plug body is non-circular to accommodate the interior wall of the container having a non-circular cross-section.

8. The plug device of claim 1, wherein the primary seal comprises a flexible segmented compressible tube.

9. The plug device of claim 1, wherein the flexible plug body and plug handle section are formed into a single integrated unit.

10. The plug device of claim 1, further comprising a removable plug cover sized to at least partially cover the flexible plug body and to form a barrier between the flexible plug body and the material in the container.

11. The plug device of claim 1, further comprising a third seal above the primary seal, wherein the third seal has an outer edge that is sized to curl upward away from the primary seal when the plug device is inserted into the container.

12. The plug device of claim 1, wherein the primary seal and the lower seal are configured to act independently to exert the resistance pressure against the interior wall of the container.

13. The plug device of claim 1, wherein the primary seal and the lower seal are configured to act independently to scrape the material from the interior wall of the container as the flexible plug body is being pushed down into the container.

14. The plug device of claim 1, wherein the flexible plug body is sized and provided with flexibility to insert into the container as an assembled unit.

15. A method for releasably sealing a material into a container, the method comprising:

locating a plurality of seals on a flexible plug body, wherein the plurality of seals comprises a primary seal and a lower seal positioned below the primary seal along the radial axis of the flexible plug body;

sizing the primary seal and the lower seal to fit within the container and to conform to contours of an interior wall of the container;

providing the primary seal with a flexible tubular structure and an outwardly facing curved surface;

providing the lower seal with a flexible outer edge that extends outwardly from a center portion of the flexible plug body further than the primary seal when the plug device is not inserted into the container;

inserting the flexible plug body into the container, further comprising:

covering a top surface of the material within the container with the lower seal, and fitting the primary seal and the lower seal against the interior wall of the container to allow both the primary seal and the lower seal to exert resistance pressure against the interior wall of the container;

allowing the resistance pressure of the plurality of seals against the interior wall of the container to releasably seal the material in the container; and improving the releasable seal by curling the flexible outer edge of the lower seal upwardly toward the primary seal to compress one side of the lower seal into the outwardly facing curved surface of the primary seal and to compress the other side of the lower seal into the interior wall of the container when the plug device is inserted into the container.

16. The method of claim 15, further comprising:

using the resistance pressure to squeeze the material from at least a portion of the interior wall of the container while the flexible plug body is being inserted into the container, and pushing the squeezed material into a pool of the material in the container.

17. The method of claim 15, further comprising: providing the flexible plug body with a plug handle; determining a depth of the material in the container with a height reference system on the plug handle; and positioning the flexible plug body within the container with reference to the determined depth.

18. The method of claim 15, further comprising removably covering at least a portion of the flexible plug body to form a barrier between the flexible plug body and the material in the container.

19. The method of claim 15, wherein allowing the primary seal and the lower seal to exert resistance pressure against the interior wall of the container further comprises exerting pressure with the primary seal independently of the lower seal.

20. The method of claim 15, further comprising scraping the material from the interior wall of the container with the primary seal and with the lower seal independently of the primary seal.

21. The method of claim 15, further comprising positioning the lower seal in the container relative to the surface of the material in at least one of the following configurations:

positioning the lower seal slightly above the surface;

positioning the lower seal touching the surface; and pressing the lower seal against the surface of the material.

22. The method of claim 15, wherein inserting the flexible plug body into the container further comprises fitting the flexible plug body into the container as an assembled unit.

* * * * *